US005664021A

United States Patent [19]

Chu et al.

[11] Patent Number: 5,664,021

[45] Date of Patent: Sep. 2, 1997

[54] MICROPHONE SYSTEM FOR TELECONFERENCING SYSTEM

[75] Inventors: Peter Lee Chu, Lexington; William F. Barton, Littleton, both of Mass.

[73] Assignee: PictureTel Corporation, Andover, Mass.

[21] Appl. No.: 132,032

[22] Filed: Oct. 5, 1993

[51] Int. Cl.[6] ..... H04R 3/00

[52] U.S. Cl. ..... 381/92; 379/202

[58] Field of Search ..... 381/92, 94, 122; 379/202, 204, 206; 367/121, 124, 125, 126

[56] References Cited

U.S. PATENT DOCUMENTS

| | | | |
|---|---|---|---|
| 3,755,625 | 8/1973 | Maston | 179/1 |
| 3,906,431 | 9/1975 | Clearwaters et al. . | |
| 4,070,547 | 1/1978 | Dellar | 179/1 |
| 4,072,821 | 2/1978 | Bauer | 179/1 |
| 4,096,353 | 6/1978 | Bauer | 179/1 |
| 4,131,760 | 12/1978 | Christensen et al. . | |
| 4,198,705 | 4/1980 | Massa | 367/126 |
| 4,237,339 | 12/1980 | Bunting et al. | 179/1 |
| 4,254,417 | 3/1981 | Spelser . | |
| 4,305,141 | 12/1981 | Massa | 367/105 |
| 4,308,425 | 12/1981 | Momose et al. | 381/92 |
| 4,334,740 | 6/1982 | Wray | 352/11 |
| 4,414,433 | 11/1983 | Horie et al. | 179/70 |
| 4,436,966 | 3/1984 | Botros | 179/121 |
| 4,449,238 | 5/1984 | Lee et al. | 381/110 |
| 4,466,117 | 8/1984 | Gorike | 381/26 |
| 4,485,484 | 11/1984 | Flanagan | 381/92 |
| 4,489,442 | 12/1984 | Anderson et al. | 381/981 |
| 4,521,908 | 6/1985 | Miyaji et al. | 381/92 |
| 4,653,102 | 3/1987 | Hansen | 381/92 |
| 4,658,425 | 4/1987 | Julstrom | 381/81 |
| 4,669,108 | 5/1987 | Deinzer | 379/61 |
| 4,696,043 | 9/1987 | Iwahara et al. | 381/92 |
| 4,712,231 | 12/1987 | Julstrom | 379/202 |
| 4,741,038 | 4/1988 | Elko et al. | 381/92 |
| 4,752,961 | 6/1988 | Kahn | 381/92 |
| 4,815,132 | 3/1989 | Minami | 381/1 |
| 4,860,366 | 8/1989 | Fukushi et al. | 381/106 |
| 4,903,247 | 2/1990 | van Gerwen et al. | 367/135 |
| 5,121,426 | 6/1992 | Baumhauer, Jr. et al. | 379/388 |
| 5,214,709 | 5/1993 | Ribic | 381/92 |

FOREIGN PATENT DOCUMENTS

| | | | |
|---|---|---|---|
| 57-10597 | 1/1982 | Japan | 381/92 |

OTHER PUBLICATIONS

"Environ (Environmental Control Microphone) Model 2N1" (advertisement from Ingenuics, Inc., Jun. 1970.

*Primary Examiner*—Forester W. Isen

*Attorney, Agent, or Firm*—Fish & Richardson P.C.

[57] ABSTRACT

A microphone system for use in an environment where an acoustic source emits energy from diverse and varying locations within the environment. The microphone system has at least two directional microphones, mixing circuitry, and control circuitry. The microphones are held each directed out from a center point. The mixing circuitry combines the electrical signals from the microphones in varying proportions to form a composite signal, the composite signal including contributions from at least two of the microphones. The control circuitry analyzes the electrical signals to determine an angular orientation of the acoustic signal relative to the central point, and substantially continuously adjusts the proportions in response to the determined orientation and provides the adjusted proportions to the mixing circuitry. The values of the proportions are selected so that the composite signal simulates a signal that would be generated by a single directional microphone pivoted about the central point to direct its maximum response at the acoustic signal as the acoustic signal moves about the environment.

19 Claims, 4 Drawing Sheets

MICROPHONE SYSTEM FOR TELECONFERENCING SYSTEM

BACKGROUND OF THE INVENTION

The invention relates to automatic selection of microphone signals.

Noise and reverberance have been persistent problems since the earliest days of sound recording. Noise and reverberance are particularly pernicious in teleconferencing systems, where several people are seated around a table, typically in an acoustically live room, each shuffling papers.

Prior methods of reducing noise and reverberance have relied on directional microphones, which are most responsive to acoustic sources on the axis of the microphone, and less responsive as the angle between the axis and the source increases. The teleconferencing room can be equipped with multiple directional microphones: either a microphone for each participant, or a microphone for each zone of the room. An automatic microphone gating circuit will turn on one microphone at a time, to pick up only the person currently speaking. The other microphones are turned off (or significantly reduced in sensitivity), thereby excluding the noise and reverberance signals being received at the other microphones. The gating is accomplished in complex analog circuitry.

SUMMARY OF THE INVENTION

In one aspect, the invention generally features a microphone system for use in an environment where an acoustic source emits energy from diverse and varying locations within the environment. The microphone system has at least two directional microphones, mixing circuitry, and control circuitry. The microphones are held each directed out from a center point. The mixing circuitry combines the electrical signals from the microphones in varying proportions to form a composite signal, the composite signal including contributions from at least two of the microphones. The control circuitry analyzes the electrical signals to determine an angular orientation of the acoustic signal relative to the central point, and substantially continuously adjusts the proportions in response to the determined orientation and provides the adjusted proportions to the mixing circuitry. The values of the proportions are selected so that the composite signal simulates a signal that would be generated by a single directional microphone pivoted about the central point to direct its maximum response at the acoustic signal as the acoustic signal moves about the environment.

Particular embodiments of the invention can include the following features. The multiple microphones are mounted in a small, unobtrusive, centrally-located "puck" to pick up the speech of people sitting around a large table. The puck may mount two dipole microphones or four cardioid microphones oriented at 90° from each other. The pivoting and directing are to discrete angles about the central point. The mixing circuitry combines the signals from the microphones by selectively adding, subtracting, or passing the signals to simulate four dipole microphones at 45° from each other. The mixing proportions are specified by combining and weighting coefficients that maintain the response of the virtual microphone at a nearly uniform level. At least two of the adjusted coefficients are neither zero nor one. The microphone system further includes echo cancellation circuitry having effect varying with the selected proportions and virtual microphone direction, the echo cancellation circuitry obtaining information from the control circuitry to determine the effect.

In a second aspect, the invention generally features a method for selecting a microphone for preferential amplification. The method is useful in a microphone system for use in an environment where an acoustic source moves about the environment. In the method, at least two microphones are provided in the environment. For each microphone, a sequence of samples corresponding to the microphone's electrical signal is produced. The samples are blocked into blocks of at least one sample each. For each block, an energy value for the samples of the block is computed, and a running peak value is formed: the running peak value equals the block's energy value if the block's energy value exceeds the running peak value formed for the previous block, and equals a decay constant times the previous running peak value otherwise. Having computed a running peak value for the block and each microphone, the running peak values for each microphone are compared. The microphone whose corresponding running peak value is largest is selected and preferentially amplified during a subsequent block.

In preferred embodiments, the method may feature the following. The energy levels are computed by subtracting an estimate of background noise. The decay constant attenuates the running peak by half in about 1/23 second. A moving sum of the running peak values for each microphone is summed before the comparing step.

In a third aspect, the invention provides a method of constructing a dipole microphone: two cardioid microphones are fixedly held near each other in opposing directions, and the signals produced by the cardioid microphones are subtracted to simulate a dipole microphone.

Among the advantages of the invention are the following. Microphone selection and mixing is implemented in software that consumes about 5% of the processing cycles of an AT&T DSP1610 digital signal processing (DSP) chip. Preferred embodiments can be implemented with a single stereo analog-to-digital converter and DSP. Since the teleconferencing system already uses the stereo ADC and DSP chip, for instance for acoustic echo cancellation, the disclosed microphone gating apparatus is significantly simpler and cheaper than one implemented in analog circuitry, and achieves superior performance. The integration of echo cancellation software and microphone selection software into a single DSP enables cooperative improvement of various signal-processing functions in the DSP.

Other objects, advantages and features of the invention will become apparent from the following description of a preferred embodiment, and from the drawings, in which:

DESCRIPTION OF PARTICULAR EMBODIMENTS OF THE INVENTION

Structure

Figure 1:
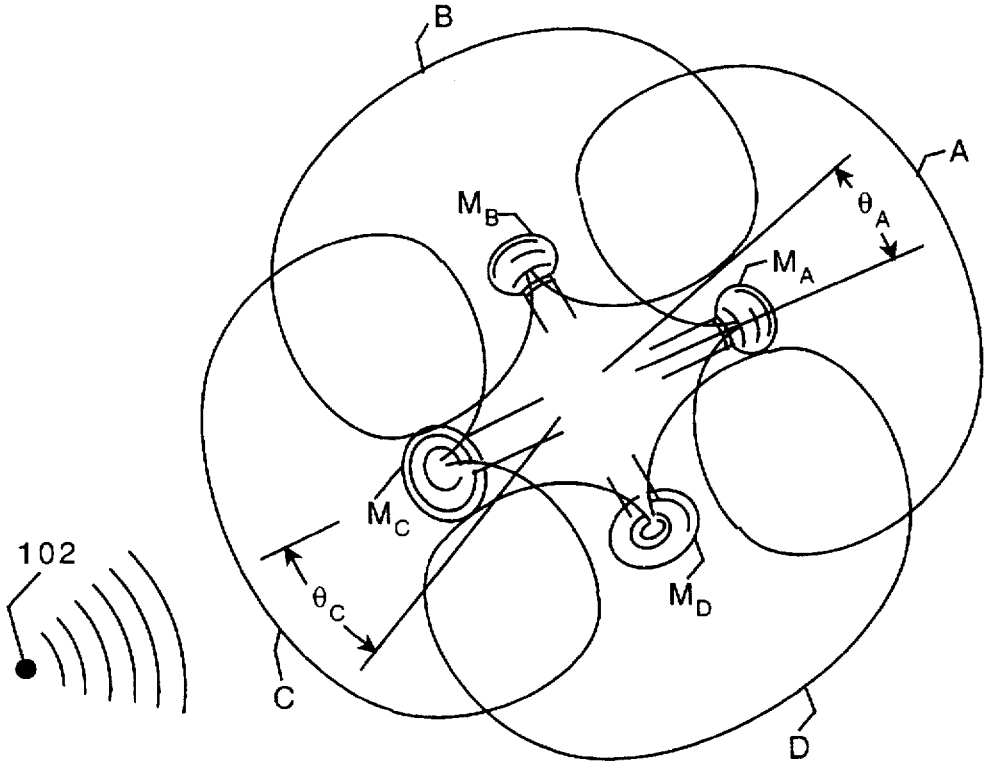
FIG. 1 is a perspective view of four microphones with their cardioid response lobes.

Referring to FIG. 1, a microphone assembly according to the invention includes four cardioid microphones $M_A$, $M_B$, $M_C$, and $M_D$ mounted perpendicularly to each other, as close to each other and as close to a table top as possible. The axes of the microphones are parallel to the table top. Each of the four microphones has a cardioid response lobe, A, B, C, and D respectively. By combining the microphones' signals in various proportions, the four cardioid microphones can be made to simulate a single "virtual" microphone that rotates to track an acoustic source as it moves (or to track among multiple sources as they speak and fall silent) around the table.

Figure 2:
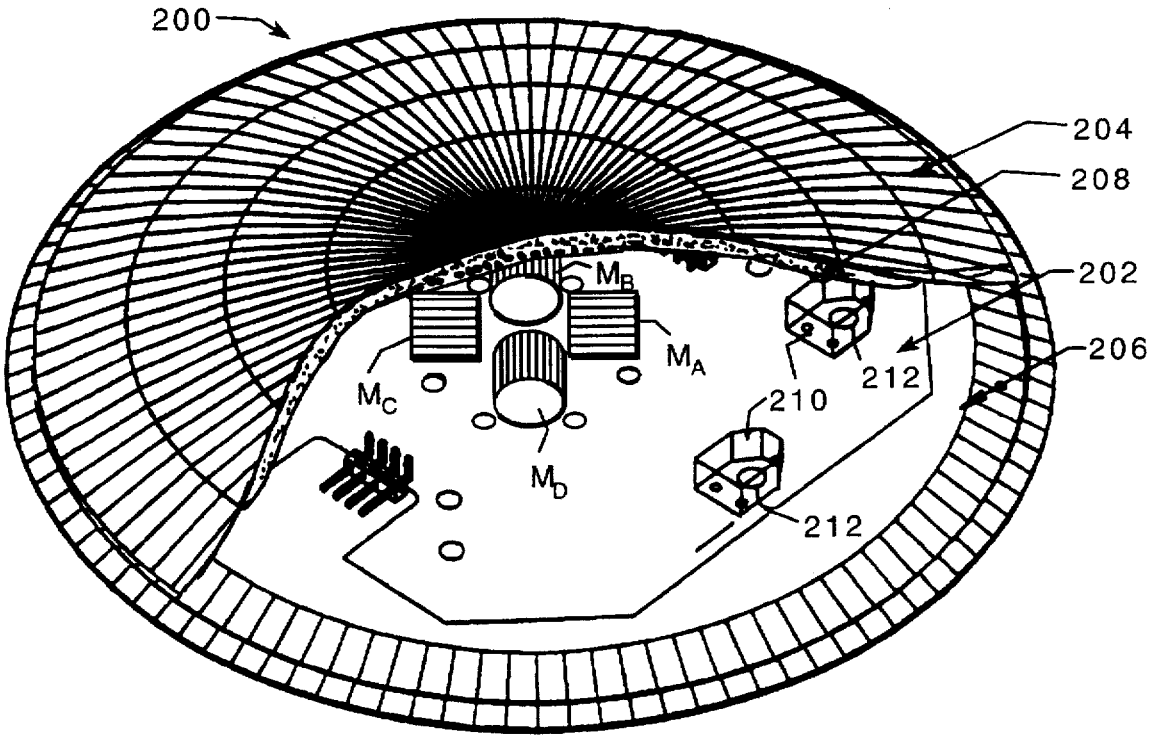
FIG. 2 is a perspective view of a microphone assembly, partially cut away.

FIG. 2 shows the microphone assembly 200, with four Primos EN75B cardioid microphones $M_A$, $M_B$, $M_C$, and $M_D$ mounted perpendicularly to each other on a printed circuit board (PCB) 202. A perforated dome cover 204 lies over a foam layer 208 and mates to a base 206. Potentiometers 210 for balancing the response of the microphones are accessible through holes 212 in the bottom of case 206 and PCB 202. The circuits on PCB 202, not shown, include four preamplifiers. Assembly 200 is about six inches in diameter and 1½ inches in height.

Referring again to FIG. 1, the response of a cardioid microphone varies with off-axis angle θ according to the function:

$$\frac{1+\cos\theta}{2}$$

This function, when plotted in polar coordinates, gives the heart-shaped response, plotted as lobes A, B, C, and D, for microphones $M_A$, $M_B$, $M_C$, and $M_D$ respectively. For instance, when $\theta_A$ is 180° (the sound source 102 is directly behind microphone $M_A$, as illustrated in FIG. 1), the amplitude response of cardioid microphone $M_A$ is zero.

Figure 3:
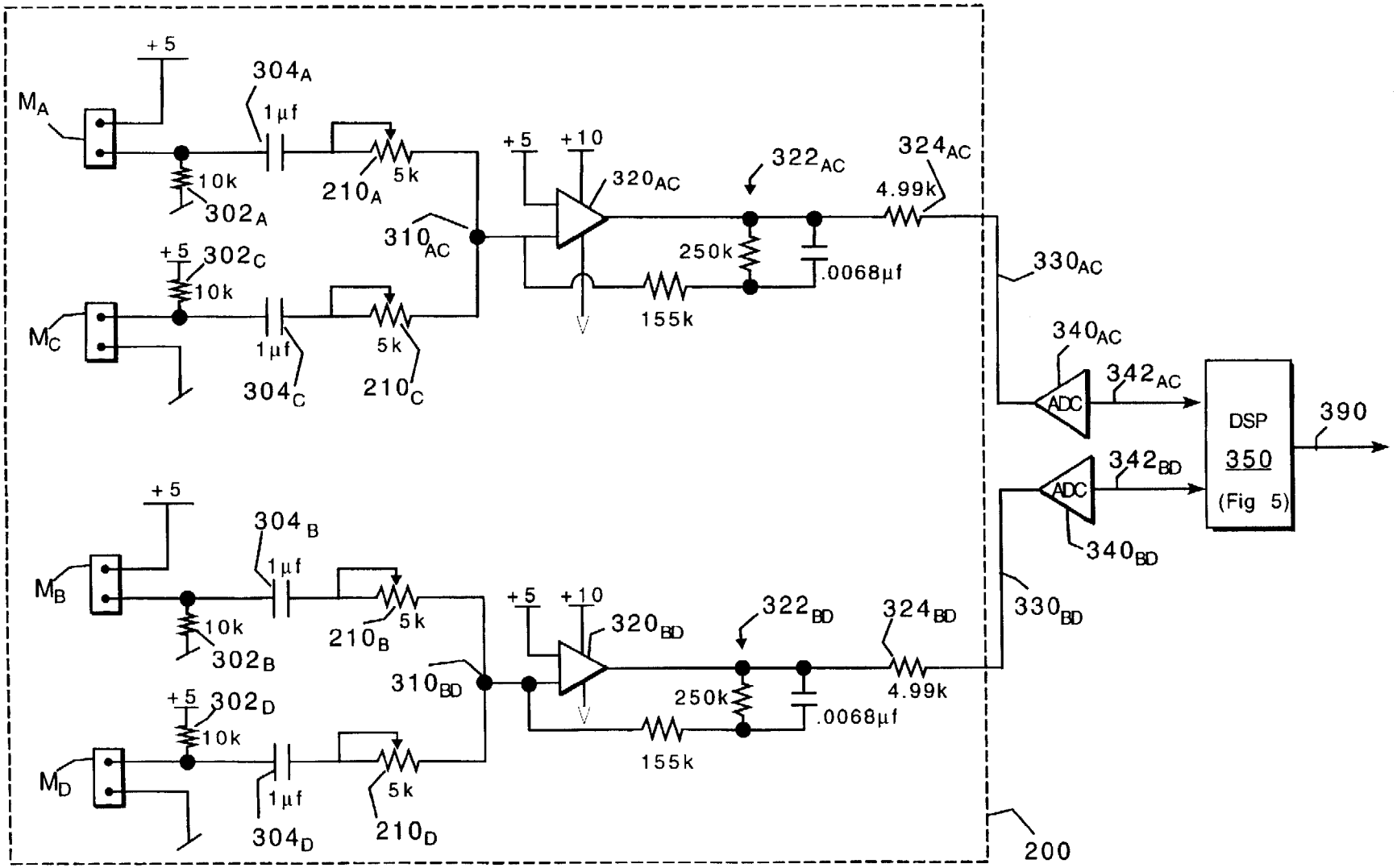
FIG. 3 is a schematic diagram of the signal processing paths for the signals generated by the microphones of the microphone assembly.

Referring to FIG. 3, the difference of an opposed pair of microphones is formed by wiring one microphone at a reverse bias relative to the other. Considering the pair $M_A$ and $M_C$, $M_A$ is wired between +5V and a 10kΩ resistor $\mathbf{302}_C$ to ground, and $M_C$ is wired between a 10kΩ resistor $\mathbf{302}_C$ to +5 V and ground. 1 μF capacitors $\mathbf{304}_A$, $\mathbf{304}_C$ and 5kΩ level-adjust potentiometers $\mathbf{210}_A$,$\mathbf{210}_C$ each connect $M_A$ and $M_C$ to an input of a differential operational amplifier $\mathbf{320}_{AC}$. A bass-boost circuit $\mathbf{322}_{AC}$ feeds back the output of the operational amplifier to the input. In other embodiments, the component values (noted above and hereafter) may vary as required by the various active components.

The output $\mathbf{330}_{AC}$,$\mathbf{330}_{BD}$ of operational amplifier $\mathbf{320}_{BD}$ is that of a virtual dipole microphone. For example, signal $\mathbf{330}_{AC}$ (the output of microphone $M_C$ minus the output of microphone $M_A$) gives a dipole microphone whose angular response is $$\frac{1+\cos\theta_A}{2}-\frac{1+\cos(\theta_C)}{2}=\frac{1+\cos\theta_A}{2}-\frac{1+\cos(\theta_A+180°)}{2}=\cos\theta_A$$

This dipole microphone has a response of 1 when $\theta_A$ is 0°, −1° when $\theta_A$ is 180°, and has response zeros when $\theta_A$ is ±90° off-axis. Similarly, signal $\mathbf{330}_{BD}$ (subtracting $M_D$ from $M_B$) simulates a dipole microphone whose angular response is $$\frac{1+\cos\theta_B}{2}-\frac{1+\cos\theta_D}{2}=\frac{1+\cos(\theta_A-90°)}{2}-\frac{1+\cos(\theta_A+90°)}{2}=\sin\theta_A$$

This dipole microphone has a response of 1 when $\theta_B$ is 0° ($\theta_A$ is 90°), −1 when $\theta_B$ is 180° ($\theta_A$ is −90°), and has response zeros when $\theta_B$ is ±90° off-axis ($\theta_A$ is 0° or 180°). The two virtual dipole microphones represented by signals $\mathbf{330}_{AC}$ and $\mathbf{30}_{BD}$ thus have response lobes at right angles to each other.

After the signals pass through a 4.99kΩ resistor $\mathbf{324}_{AC}$, $\mathbf{324}_{BD}$, the analog differences $\mathbf{330}_{AC}$ and $\mathbf{330}_{BD}$ are converted by analog-to-digital converters (ADC) $\mathbf{340}_{AC}$ and $\mathbf{340}_{BD}$ to digital form, $\mathbf{342}_{AC}$ and $\mathbf{342}_{BD}$, at a rate of 16,000 samples per second. ADC's $\mathbf{340}_{AC}$ and $\mathbf{340}_{BD}$ may be, for example, the right and left channels, respectively, of a stereo ADC.

Referring to FIGS. 4a–4d, output signals $\mathbf{342}_{AC}$ and $\mathbf{342}_{BD}$ can be further added to or subtracted from each other in a digital signal processor (DSP) 350 to obtain additional microphone response patterns. The sum of signals $\mathbf{342}_{AC}$ and $\mathbf{342}_{BD}$ is $$\cos\theta_A+\sin\theta_A=\sqrt{2}\ \cos(\theta_A-45°)$$

Figure 4A:
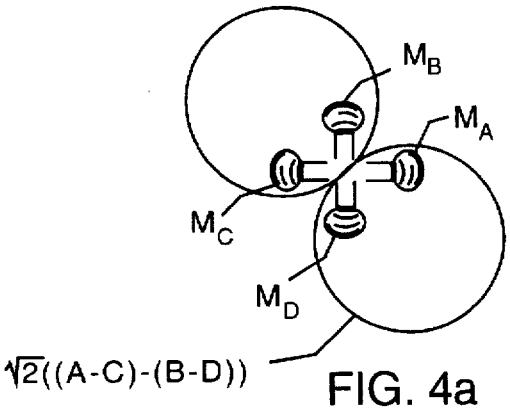
FIGS. 4*a*–4*d* are plan views of four cardioid microphones and the response lobes obtained by combining their signals in varying proportions.
Figure 4B:
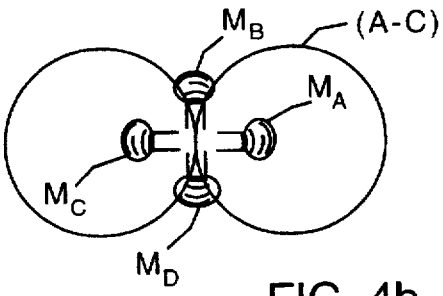
Figure 4C:
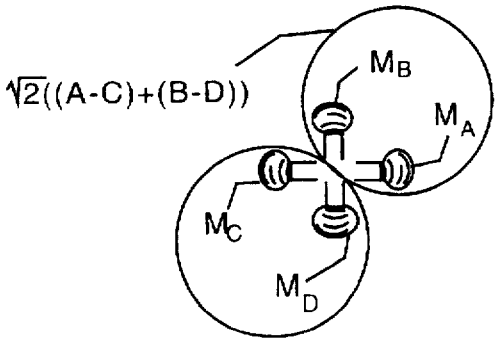
Figure 4D:
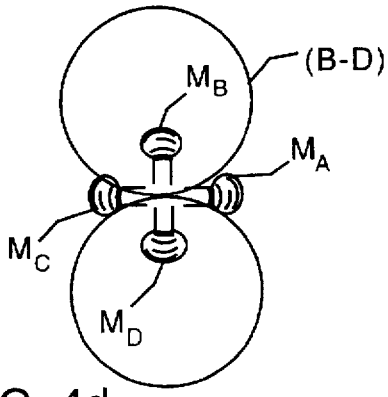

This corresponds to the virtual dipole microphone illustrated in FIG. 4c whose response lobe is shifted 45° off the axis of microphone $M_A$ (halfway between microphones $M_A$ and $M_B$).

Similarly, the difference of the signals is $$212_{AC}-212_{BD}=\cos\theta_A-\sin\theta_A=\sqrt{2}\ \cos(\theta_A+45°)$$

corresponding to the virtual dipole microphone illustrated in FIG. 4a whose response lobe is shifted −45° (halfway between microphones $M_A$ and $M_D$).

The sum and difference signals of FIGS. 4a and 4c are scaled by $1/\sqrt{2}$ in digital signal processor 350 to obtain uniform-amplitude on-axis response between the four virtual dipole microphones.

The response to an acoustic source halfway between two adjacent virtual dipoles will be cos (22.5°) or 0.9239, down only 0.688 dB from on-axis response. Thus, the four dipole microphones cover a 360° space around the microphone assembly with no gaps in coverage.

Operation

Figure 5:
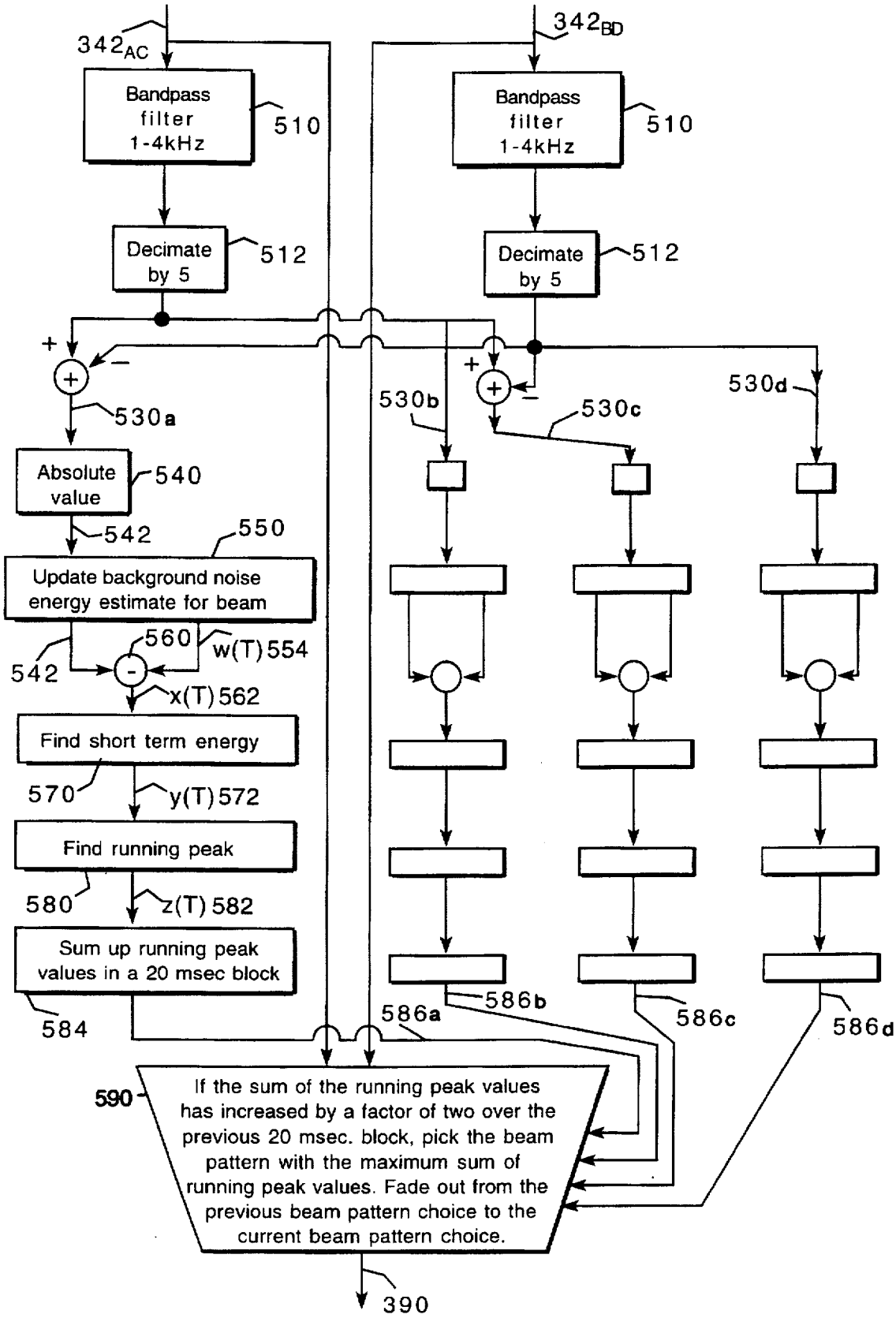
FIG. 5 is a flow chart of a microphone selection method of the invention.

FIG. 5 shows the method for choosing among the four virtual dipole microphones. The method is insensitive to constant background noise from computers, air-conditioning vents, etc., and also to reverberant energy.

Digitized signals $\mathbf{342}_{AC}$ and $\mathbf{342}_{BD}$ enter the DSP. Background noise is removed from essential speech frequencies in 1–4 kHz bandpass 20-tap finite impulse response filters 510. The resulting signal is decimated by five in step 512 (four of every five samples are ignored by steps downstream of 512) to reduce the amount to computation required. Then, the four virtual dipole signals $\mathbf{530}_a$–$\mathbf{530}_d$ are formed by summing, subtracting, and passing signals $\mathbf{342}_{AC}$ and $\mathbf{342}_{BD}$.

FIG. 5 and the following discussion describe the processing for signal $\mathbf{530}_a$ in detail; the processing for signals $\mathbf{530}_b$ through $\mathbf{530}_d$ are identical until step 590. Several of the following steps block the samples into 20 msec blocks (80 of the decimated-by-five 3.2 kHz samples per block). These functions are described below using time variable T. Other steps compute a function on each decimated sample; these functions are described using time variable t.

Step 540 takes the absolute value of signal $530_a$, so that rough energy measurements occurring later in the method may be computed by simply summing together the resulting samples u(T) 542.

Step 550 estimates background noise. The samples are blocked into 20 msec blocks and an average is computed for the samples in each block. The background noise level is assumed to be the minimum value v(T) over the previous 100 blocks energy level values 542. The current block's noise estimate w(T) 554 is computed from the previous noise estimate w(T-1) and the current minimum block average energy estimate v(T) using the formula $$w(T)=0.75w(T-1)+0.25v(T)$$

In step 560, the block's background noise estimate w(T) 554 is subtracted from the sample's energy estimate u(T) 542. If the difference is negative, then the value is set to zero to form noise-cancelled sample-rate energies x(t) 562.

Step 570 finds the short term energy. The noise-cancelled sample-rate energies x(t) 562 are fed to an integrator to form short term energy estimates y(t) 572:

$$y(t)=0.75y(t-1)+0.25x(t)$$

Step 580 computes a running peak value z(t) 582 at the 3.2 kHz sample rate, whose value corresponds to the direct path energy from the sound source minus noise and reverberance, to mitigate the effects of reverberant energy on the selection from among the virtual microphones. If y(t)>z(t−1) then z(t)=y(t). Otherwise, z(t)=0.996 z(t−1). The running peak half-decays in 173 3.2 kHz sample times, about 1/18 second. Other decay constants, for instance those giving half-attenuation times between 1/5 and 1/100 second, are also useful, depending on room acoustics, distance of acoustic sources from the microphone assembly, etc.

Step 584 sums the 64 running peak values in each 20 msec block to form signal $586_a$.

Similar steps are used to form running peak sums $586_b$–$586_d$ for input to step 590.

In step 590, the virtual dipole microphone having the maximum result $586_a$–$586_d$ is chosen as the virtual microphone to be generated by adding, subtracting, or passing signals $342_{AC}$ and $342_{BD}$ to form output signal 390. For the method to switch microphone choices, the maximum value $586_a$–$586_d$ for the new microphone must be at least 1 dB above the value $586_a$–$586_d$ for the virtual microphone previously selected. This hysteresis prevents the microphone from "dithering" between two virtual microphones if, for instance, the acoustic source is located nearly at the angle where the response of two virtual microphones is equal. The selection decision is made every 20 msec. At block boundaries, the output is faded between the old virtual microphone and the new over eight samples.

Interaction of microphone selection with other processing

In a teleconferencing system, the microphone assembly will typically be used with a loudspeaker to reproduce sounds from a remote teleconferencing station. In the preferred embodiment, software manages interactions between the loudspeaker and the microphones, for instance to avoid "confusing" the microphone selection method and to improve acoustic echo cancellation. In the preferred embodiment, these interactions are implemented in the DSP 350 along with the microphone selection feature, and thus each of the analyses can benefit from the results of the other, for instance to improve echo cancellation based on microphone selection.

When the loudspeaker is reproducing speech from the remote teleconferencing station, the microphone selection method may be disabled. This determination is made by known methods, for instance that described in U.S. patent application Ser. No. 08/086,707, incorporated herein by reference. When the loudspeaker is emitting far end background noise, the microphone selection method operates normally.

A teleconferencing system includes acoustic echo cancellation, to cancel sound from the loudspeaker from the microphone input, as described in U.S. patent applications Ser. No. 07/659,579 and 07/837,729 (incorporated by reference herein). A sound produced by the loudspeaker will be received by the microphone delayed in time and altered in frequency, as determined by the acoustics of the room, the relative geometry of the loudspeaker and the microphone, the location of other objects in the room, the behavior of the loudspeaker and microphone themselves, and the behavior of the loudspeaker and microphone circuitry, collectively known as the "room response." As long as the audio system has negligible nonlinear distortion, the loudspeaker-to-microphone path can be well modeled by a finite impulse response (FIR) filter.

The echo canceler divides the full audio frequency band into subbands, and maintains an estimate for the room response for each subband, modeled as an FIR filter.

The echo canceler is "adaptive:" it updates its filters in response to change in the room response in each subband. Typically, the time required for a subband's filter to converge from some initial state (that is, to come as close to the actual room response as the adaptation method will allow) increases with the initial difference of the filter from the actual room response. For large differences, this convergence time can be several seconds, during which the echo cancellation performance is inadequate.

The actual room response can be decomposed into a "primary response" and a "perturbation response." The primary response reflects those elements of the room response that are constant or change only over times in the tens of seconds, for instance the geometry and surface characteristics of the room and large objects in the room, and the geometry of the loudspeaker and microphone. The perturbation response reflects those elements of the room response that change slightly and rapidly, such as air flow patterns, the positions of people in their chairs, etc. These small perturbations produce only slight degradation in echo cancellation, and the filters rapidly reconverge to restore full echo cancellation.

In typical teleconferencing applications, changes in the room response are due primarily to changes in the perturbation response. Changes in primary response result in poor echo cancellation while the filters reconverge. If the primary response changes only rarely, as when a microphone is moved, adaptive echo cancellation gives acceptable performance. But if primary room response changes frequently, as occurs whenever a new microphone is selected, the change in room response may be large enough to result in poor echo cancellation and a long reconvergence time to reestablish good echo cancellation.

An echo canceler for use with the microphone selection method maintains one version of its response-sensitive state (the adaptive filter parameters for each subband and background noise estimates) for each virtual microphone. When a new virtual microphone is selected, the echo canceler stores the current response-sensitive state for the current virtual microphone and loads the response-sensitive state for the newly-selected virtual microphone.

Because storage space for the full response-sensitive state for all virtual microphones would exceed a tolerable storage quota, each virtual microphone's response-sensitive state is stored in a compressed form. To achieve sufficient compression, lossy compression methods are used to compress and store blocks of filter taps: each 16-bit tap value is compressed to four bits. The following method reduces compression losses, maintaining sufficient detail in the filter shape to avoid noticeable reconvergence when the filter is retrieved from compressed storage.

The adaptive filters typically have peak values at a relatively small delay corresponding to the length of the direct path from the loudspeaker to the microphone, with a slowly-decaying "tail" at greater delays, corresponding to the slowly-decaying reverberation. When compressing a block of filter data, each filter is split into several blocks, e.g., four, so that the large values typical of the first block will not swamp out small values in the reverberation tail blocks.

As each block of 16-bits taps is compressed, the tap values in the block are normalized as follows. For the largest actual tap value in the block, the maximum number of left shifts that may be performed without losing any significant bits is found. This shift count is saved with each block of compressed taps, so that the corresponding number of right shifts may be performed when the block is expanded.

The most significant eight bits of the normalized tap values are non-linearly quantized down to four bits. One of the four bits is used for the sign bit of the tap value. The remaining three bits encode the magnitude of the eight-bit input value as follows:

| 7-bit magnitude | 3-bit quantization |
|---|---|
| 0–16 | 0 |
| 17–25 | 1 |
| 26–37 | 2 |
| 38–56 | 3 |
| 57–69 | 4 |
| 70–85 | 5 |
| 86–104 | 6 |
| 105–127 | 7 |

Alternately, the echo canceler could store two filter parameter sets, one set corresponding to the A-C dipole microphone, and one to the B-D dipole. As microphone selection varies, the correct echo cancellation filter values could be derived by computation analogous to that used to combine the microphone signals. For instance, the transfer function coefficients for the ((A-C)–(B-D)) virtual microphone of FIG. 4*a* could be derived by subtracting the corresponding coefficients and scaling them by $\sqrt{2}$.

The echo canceler may be implemented in a DSP with a small "fast" memory and a larger "slow" memory. The time required to swap out one response-sensitive state to slow memory and swap in another may exceed the time available. Therefore, once during every 20 msec update interval (the processing interval during which the echo canceler state is updated) a subset of the response-sensitive state is copied to slow memory. The present embodiment stores one of its 29 subband filters each update interval, so the entire set of subband filters for the currently-active virtual microphone is stored every 0.58 seconds.

The response-sensitive state of the echo canceler is updated only when the associated virtual microphone is active. In order to keep the echo cancellation state reasonably up-to-date for each of the virtual microphones, the echo canceler forces the selection of a virtual microphone when the current microphone has received no nonnoise energy for some interval, e.g. one minute. The presence of non-noise energy is reported to the microphone selector by the echo canceler.

Alternate embodiments

Figure 6:
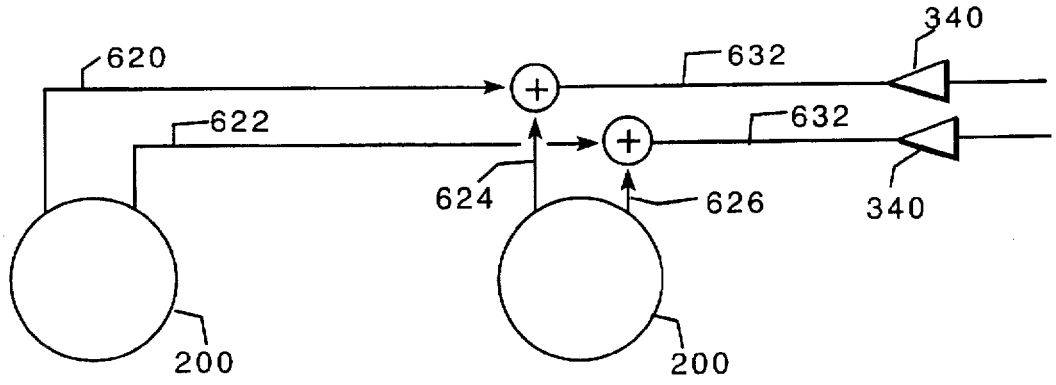
FIG. 6 is a schematic view of two microphone assemblies daisy chained together.

A single microphone assembly works well for speech within a seven-foot radius about the microphone assembly. As shown in FIG. 6, two microphone assemblies 200 may be used together by adding together the left channels 620, 624 of the two microphone assemblies and adding together the two right channels 622, 626. The two summed channels 632 are then fed to analog-to-digital converters 340, as in FIG. 3. The selection method of FIG. 5 works well for the daisy-chained configuration of FIG. 6.

In the daisy-chained configuration of FIG. 6, the second assembly increases noise and reverberance by 3 dB, which has the effect of reducing the radius of coverage of each microphone assembly from seven feet to five feet. Since two five-foot radius circles have the same area as one seven-foot radius circle, use of multiple microphone assemblies alters the shape of the coverage area rather than expanding it.

By computing appropriate weighted sums of multiple microphones lying in a single plane and oriented at angles to each other, it is possible to derive a virtual microphone rotated to any arbitrary angle in the plane of the real microphones. Once an acoustic source is localized, the two microphones oriented closest to the acoustic source would have their inputs combined in a suitable ratio. In some embodiments, proportions of the inputs from other microphones would be subtracted. The summed signal would be scaled to keep the response of the combined signal nearly constant as the response is directed to different angles. The combining ratios and scaling constants will be determined by the geometry and orientation of the microphones' response lobes. For instance, if the microphone assembly includes three microphones oriented at 60° from each other, an acoustic source oriented exactly between two microphones might best be picked up by combining the signals from the two forward-facing microphones with weights $1/(1+\cos 30°)$.

By adding a microphone pointing out of the plane of the other microphones, it becomes possible to orient a virtual microphone to any spatial angle.

Other embodiments are within the following claims.

What is claimed is:

1. A microphone system for use in a conference environment where an acoustic source emits energy from diverse and varying locations within the environment, comprising:

at least two directional microphones held in a fixed arrangement about a center point, the respective response of each said microphone being directed radially away from said center point in a different direction, each said microphone able to receive an acoustic signal and produce an electrical signal in response, said microphones comprising two dipole microphones oriented at 90° from each other;

mixing circuitry to combine said electrical signals in varying proportions to form a composite signal, said composite signal including contributions from at least two of said microphones; and control circuitry configured to analyze said electrical signals to determine an angular orientation of the acoustic signal relative to said central point, and to substantially continuously adjust said proportions in response to said determined orientation and provide said adjusted proportions to said mixing circuitry.

the values of said proportions selected so that said composite signal simulates a signal that would be generated by a virtual directional microphone pivoted about said central point to direct its maximum response at the acoustic signal as the acoustic signal moves about the environment.

2. The microphone system of claim 1, wherein said acoustic source comprises a plurality of discrete speakers each located at one of said diverse locations within the environment.

3. The microphone system of claim 1 wherein said mixing circuitry combines the signals from said two dipole microphones by selectively adding, subtracting, or passing said signals to simulate four dipole microphones at 45° from each other.

4. The microphone system of claim 1 wherein said mixing and control circuitry comprise a digital signal processor.

5. The microphone system of claim 1, further comprising echo cancellation circuitry having effect varying with the selected proportions and virtual directional microphone direction, said echo cancellation circuitry obtaining information from said control circuitry to determine said effect.

6. The microphone system of claim 1, wherein said pivoting and directing are to discrete angles about said central point.

7. A microphone system for use in a conference environment where an acoustic source emits energy from diverse and varying locations within the environment, comprising:

at least two directional microphones held in a fixed arrangement about a center point, the respective response of each said microphone being directed radially away from said center point in a different direction, each said microphone able to receive an acoustic signal and produce an electrical signal in response;

mixing circuitry to combine said electrical signals in varying proportions to form a composite signal, said composite signal including contributions from at least two of said microphones;

control circuitry configured to analyze said electrical signals to determine an angular orientation of the acoustic signal relative to said central point, and to substantially continuously adjust said proportions in response to said determined orientation and provide said adjusted proportions to said mixing circuitry, the values of said proportions selected so that said composite signal simulates a signal that would be generated by a virtual directional microphone pivoted about said central point to direct its maximum response at the acoustic signal as the acoustic signal moves about the environment, and wherein said microphones comprise four cardioid microphones oriented at 90° to each other.

8. The microphone system of claim 7 wherein the electrical signals combined by said mixing circuitry comprise signals that are differences of electrical signals from opposing pairs of said cardioid microphones.

9. A microphone system for use in a conference environment where an acoustic source emits energy from diverse and varying locations within the environment, comprising:

at least two directional microphones held in a fixed arrangement about a center point, the respective response of each said microphone being directed radially away from said center point in a different direction, each said microphone able to receive an acoustic signal and produce an electrical signal in response;

mixing circuitry to combine said electrical signals in varying proportions to form a composite signal, said composite signal including contributions from at least two of said microphones;

control circuitry configured to analyze said electrical signals to determine an angular orientation of the acoustic signal relative to said central point, and to substantially continuously adjust said proportions in response to said determined orientation and provide said adjusted proportions to said mixing circuitry.

the values of said proportions selected so that said composite signal simulates a signal that would be generated by a virtual directional microphone pivoted about said central point to direct its maximum response at the acoustic signal as the acoustic signal moves about the environment, and said control circuitry analyzes said electrical signals by a method comprising the steps:

blocking each said electrical signal into a sequence of blocks corresponding to time windows of a fixed length, and performing the following steps for each block:

computing an energy value for said block; and forming a running peak value, being equal to the block's energy value if the block's energy value exceeds the running peak value formed for the previous block, and being equal to a decay constant times the previous block's running peak value otherwise;

having computed a running peak value for a block and for at least two pivotal directions of said virtual directional microphone, comparing the block's running peak values for each said direction; and adjusting said proportions so that said mixing circuitry will select during a subsequent block the virtual directional microphone direction whose corresponding running peak value is largest.

10. A microphone system for use in a conference environment where an acoustic source emits energy from diverse and varying locations within the environment, comprising:

at least two directional microphones held in a fixed arrangement about a center point, the respective response of each said microphone being directed radially away from said center point in a different direction, each said microphone able to receive an acoustic signal and produce an electrical signal in response;

mixing circuitry to combine said electrical signals in varying proportions to form a composite signal, said composite signal including contributions from at least two of said microphones;

control circuitry configured to analyze said electrical signals to determine an angular orientation of the acoustic signal relative to said central point, and to substantially continuously adjust said proportions in response to said determined orientation and provide said adjusted proportions to said mixing circuitry, the values of said proportions selected so that said composite signal simulates a signal that would be generated by a virtual directional microphone pivoted about said central point to direct its maximum response at the acoustic signal as the acoustic signal moves about the environment, and said proportions are specified by combining and weighting coefficients that maintain the response of said virtual directional microphone at a nearly uniform level, said coefficients being selected from a group whose values being about 1, 0, −1, $\sqrt{2}/2$, and $-\sqrt{2}/2$.

11. A method of combining signals from at least two directional microphones in a conference environment with an acoustic source that emits energy from diverse and varying locations within the environment, each said microphone able to receive an acoustic signal and produce an electrical signal in response, the method comprising the steps of:

mounting the microphones in a fixed arrangement about a center point, the respective responses of said microphones being directed radially away from said center point in different directions;

mixing the electrical signals in varying proportions to form a composite signal, said composite signal including contributions from at least two of said microphones;

analyzing said electrical signals to determine an angular orientation of the acoustic signal relative to said central point;

substantially continuously selecting and adjusting said proportions in response to said determined orientation and providing said adjusted proportions to said mixing step, the values of said proportions selected so that said composite signal simulates a signal that would be generated by a virtual directional microphone pivoted about said central point to direct its maximum response at the acoustic signal as the acoustic signal moves about the environment, and the mounting step further comprising either one of the two following steps:

providing two dipole microphones and orienting them at 90° from each other; and providing four cardioid microphones and orienting them at 90° to each other; and the mixing step further comprises forming scaled sums and differences of said electrical signals.

12. The method of claim 11, further comprising the step:

responsive to said selecting of proportion values, adjusting the behavior of echo cancellation circuitry.

13. A method of combining signals from at least two directional microphones in a conference environment with an acoustic source that emits energy from diverse and varying locations within the environment, each said microphone able to receive an acoustic signal and produce an electrical signal in response, the method comprising the steps of:

mounting the microphones in a fixed arrangement about a center point, the respective responses of said microphones being directed radially away from said center point in different directions;

mixing the electrical signals in varying proportions to form a composite signal, said composite signal including contributions from at least two of said microphones;

analyzing said electrical signals to determine an angular orientation of the acoustic signal relative to said central point;

substantially continuously selecting and adjusting said proportions in response to said determined orientation and providing said adjusted proportions to said mixing step, the values of said proportions selected so that said composite signal simulates a signal that would be generated by a virtual directional microphone pivoted about said central point to direct its maximum response at the acoustic signal as the acoustic signal moves about the environment;

blocking each said electrical signal into a sequence of blocks corresponding to time windows of a fixed length, and performing the following steps for each block:

computing an energy value for said block; and forming a running peak value, being equal to the block's energy value if the block's energy value exceeds the running peak value formed for the previous block, and being equal to a decay constant times the previous running peak value otherwise;

having computed a running peak value for a block and for at least two pivotal directions of said virtual directional microphone, comparing the block's running peak values for each said direction; and adjusting said proportions so that said mixing circuitry will select during a subsequent block the virtual directional microphone direction whose corresponding running peak value is largest.

14. In a microphone system for use in an environment where an acoustic source moves about the environment, a method comprising the steps of:

providing at least two microphones in said environment, each said microphone receiving an acoustic signal from the acoustic source and producing an electrical signal in response thereto;

for each said microphone, producing a sequence of samples corresponding to said electrical signal;

blocking said samples into blocks of at least one sample each, and performing the following steps for each block:

computing an energy value for the samples of said block; and forming a running peak value, the running peak value being equal to the block's energy value if the block's energy value exceeds the running peak value formed for the previous block, and the running peak value being equal to a decay constant times the previous running peak value otherwise;

having computed a running peak value for a block and each microphone, comparing said running peak values for each said microphone; and selecting and preferentially amplifying during a subsequent block the microphone whose corresponding running peak value is largest.

15. The method of claim 14 wherein said microphones are four dipole microphones arranged at 45° to each other.

16. The method of claim 15 wherein said four dipole microphones are virtual directional microphones formed by adding, subtracting, and passing difference signals, the difference signals being formed by subtracting the signals from opposing pairs of four cardioid microphones oriented at 90° to each other.

17. The method of claim 14 wherein said energy levels are computed by subtracting an estimate of background noise.

18. The method of claim 14 wherein said decay constant attenuates said running peak by half in about 1/18 second.

19. The method of claim 14 wherein a moving sum of said running peak values for each said microphone is summed to form the values compared in the comparing step.

* * * * *